US009086642B2

(12) United States Patent
Imamura

(10) Patent No.: US 9,086,642 B2
(45) Date of Patent: Jul. 21, 2015

(54) CHARGING MEMBER AND IMAGE FORMING APPARATUS

(75) Inventor: Issei Imamura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 13/314,687

(22) Filed: Dec. 8, 2011

(65) Prior Publication Data

US 2012/0148308 A1 Jun. 14, 2012

(30) Foreign Application Priority Data

Dec. 14, 2010 (JP) ..... 2010-278183

(51) Int. Cl.
*G03G 15/02* (2006.01)

(52) U.S. Cl.
CPC ..... *G03G 15/0233* (2013.01); *G03G 15/025* (2013.01)

(58) Field of Classification Search
CPC ..... G03G 15/0233
USPC ..... 399/174
See application file for complete search history.

(56) References Cited

U.S. PATENT DOCUMENTS

| | | | | |
|---|---|---|---|---|
| 5,126,913 | A * | 6/1992 | Araya et al. | 361/225 |
| 5,535,088 | A * | 7/1996 | Sato et al. | 361/225 |
| 5,881,343 | A | 3/1999 | Momotani et al. | |
| 5,999,773 | A | 12/1999 | Yasutomi et al. | |
| 6,963,714 | B2 | 11/2005 | Otomo et al. | |
| 7,639,956 | B2 | 12/2009 | Naito et al. | |
| 7,692,804 | B2 | 4/2010 | Naito et al. | |
| 2007/0177896 | A1 | 8/2007 | Okuda | |
| 2009/0180794 | A1 | 7/2009 | Tanaka | |
| 2012/0148307 | A1 | 6/2012 | Namiki | |
| 2012/0148308 | A1 | 6/2012 | Imamura | |
| 2012/0148309 | A1 | 6/2012 | Oshima et al. | |
| 2013/0170859 | A1 | 7/2013 | Kishi et al. | |

FOREIGN PATENT DOCUMENTS

| | | |
|---|---|---|
| JP | 08-062938 | 8/1996 |
| JP | 09-319183 | 12/1997 |
| JP | 11-202597 | 7/1999 |
| JP | 2011186034 | 9/2011 |

* cited by examiner

*Primary Examiner* — Benjamin Schmitt
(74) *Attorney, Agent, or Firm* — Fitzpatrick, Cella, Harper & Scinto

(57) ABSTRACT

A blade-like charging member for charging a surface of an image bearing member. The blade-like charging member includes a charging portion for effecting electric discharge to the surface of the image bearing member and a non-charging portion. The non-charging portion can contact the image bearing member with a gap. At least a part of the non-charging portion is made of a material having a higher resistance than that of the charging portion so as to prevent electric discharge between the non-charging portion and the surface of the image bearing member. The non-charging portion is capable of sliding contact with the surface of the image bearing member over the entirety of an image forming region width of the surface of the image bearing member. The charge portion and the non-charging portion are bonded to each other by adhesive material at a connection interface.

5 Claims, 7 Drawing Sheets

CHARGING MEMBER AND IMAGE FORMING APPARATUS

FIELD OF THE INVENTION AND RELATED ART

The present invention relates to a blade-like charging member for charging a surface of an image bearing member, the charging member being moved relative to an image bearing member (member to be charged) carrying an electrostatic latent image in contact thereto while being supplied with a voltage, and to an image forming apparatus using the charging member.

Here, a typical example of the image bearing member on which the electrostatic latent image is formed is an electrophotographic photosensitive member or a dielectric member for electrostatic recording. As for the image forming apparatus, there are an electrophotographic type or electrostatic recording type copying machine, printer, facsimile machine or a complex machine thereof, and an image display device or the like.

The description will be made as to a transfer type electrophotographic image forming apparatus, taking for example. Generally, in such an apparatus, the electrostatic latent image of image information is formed by charging means for charging uniformly a surface of the image bearing member (rotatable drum type electrophotographic photosensitive member) to a predetermined polarity and potential and by exposure means for selectively exposing the thus charged drum surface to the light of the image information. The latent image is visualized (developed) into a toner image using a developer (toner) by developing means. The toner image is transferred onto a recording material (recording material) by transferring means. The transferred toner image is fixed by fixing means into a fixed image on the recording material, and then the recording material is outputted as a print.

A recently dominant charging means (charging device) is a contact-charging type means using a fixed type charging member such as a blade or film, or a rotating type charging member such as a brush, roller, belt of semiconductive rubber or resin material.

The contact-charging type does not necessitate an ozone removing filter because the amount of produced ozone is small. The required voltage applied to provide the surface of the drum with a predetermined potential may be small, and therefore, the cost can be reduced.

A charging mechanism of the contact-charging type will be described. It is known that the charging mechanism for the drum surface in the contact charging system is ruled by the Paschen law relating to the electric discharge in a small gap.

1) In the Case of Charging Roller:

Referring to FIG. 6, parts (a) and (b) are a schematic perspective view and a schematic sectional view of a charging roller using a rotating type charging roller 21 as the charging member. The charging roller 21 comprises an electroconductive core metal and the electroconductive elastic layer 21*b* formed on the core metal 21*a* concentrically therewith. The drum 1 comprises an electroconductive drum base member 12 and a photosensitive layer formed on the outer surface of the drum base member 12. The charging roller 21 is substantially parallel with the drum 1 and is contacted at a predetermined urging force.

The charging roller 21 has a length to cover an image forming region (maximum image region width) G of the surface of the drum 1 and is rotated by the rotation of the drum 1. To the core metal 21*a* of the charging roller 21, a predetermined charging bias voltage is applied from the charging bias voltage applying source E so that a bias voltage is applied to the elastic layer 21*b* through the core metal 21*a*. By this, the surface of the rotation drum 1 is charged uniformly to the predetermined polarity and potential.

Part (c) of FIG. 6 shows an electrical equivalent circuit of the drum 1 and the air layer of the fine gap concerned with the discharge between the charging roller 21 and the drum 1. An impedance of the charging roller 21 is small as compared with that of drum 1 and that of the air layer, and therefore, it is neglected here. Then, charging mechanism can be expressed by two capacitors C1, C2 simply. When a DC voltage is applied to the equivalent circuit, the is divided proportionally to the impedances of the capacitors, and therefore, the voltage Vair across the air layer is, $$V\text{air}=C2/(C1+C2)$$

The air layer has a dielectric breakdown voltage determined by the Paschen law, and it is as follows when the thickness of the air layer is g [micron]:

$$312+6.2g[V] \quad (2)$$

When Vair exceeds this, the discharge occurs.

The minimum discharging voltage is that when formula (1) is equal to formula (2) and the air layer thickness g obtained by the equation has a double root (C1 is also a function of g), and a DC voltage value at this time is a discharge starting voltage Vth. The theoretical value Vth thus obtained is very close to an experiment value.

The charging roller tends to be complicated in the structure since it requires a rotatable supporting member 211, an urging spring 212 and so on for the charging roller 21. A brush charging member (charging brush) is time-consuming in manufacturing the brush irrespective of whether it is rotating type or fixing type, and tracks of the brush fibers may result in unevenness of charging.

2) In the Case of Charging Blade:

Part (a) of FIG. 7 is a schematic perspective view of a charging blade using a fixing type charging blade 22 as the charging member. The charging blade comprises an electroconductive elastic blade portion 220 as a charging blade 22 and an electroconductive supporting member 223 supporting the blade portion 220. The blade portion 220 has a length enough to cover the entire width of the image forming region of the surface of the drum 1. The charging blade 22 is set substantially parallel with the drum 1, the blade portion 220 is contacted to the, and the supporting member 223 is fixed to a stationary member).

A predetermined charging bias voltage is applied from a charging bias voltage applying source to the supporting member 223, so that the bias voltage is applied to the blade portion 220 through is supporting member 223. By this, the surface of the rotation drum 1 is charged uniformly to the predetermined polarity and potential. The discharge occurs in the wedged small gap formed between the blade portion 220 and the drum 1, and a relatively stable small gap can be formed. The rotation supporting member 211 and the urging spring 212 and so on required by the charging roller are unnecessary, and therefore, the blade type is inexpensive.

However, a part of the blade portion 220 of the charging blade 22 is always in contact with the drum 1, and therefore, involves the following problems.

A: as shown in part (b) of FIG. 7, the toner T or the like having passed through the contact portion between the blade portion 220 and the drum 1 may accumulate gradually in the small gap g. Increased accumulation of the toner T or the like prevents the discharge with the result of an image defect in the form of stripes.

B: in order to prevent pin hole leakage which is a leakage of the voltage applied to the blade portion 220 through pin holes existing on the surface of the drum 1, a protection layer is provided on the blade portion 220 at the position contacting the drum 1 in many cases. In such cases, the protection layer is worn with long term use, and then the pin hole leakage may occur.

Japanese Laid-open Patent Application Hei 09-319183 proposes a structure comprising a plate-like blade having an insulative elastic member and a charging electrode layer provided on a surface of the blade which opposes to the drum, in which a distance from a free end of the blade to a free end of the charging electrode layer is selected. This is intended to suppress image defects of stripes attributable to accumulation, on the charging electrode layer, of toner or the like having passed under the blade.

However, the structure involves the following problems. As shown in part (a) of FIG. 8, in the case that an insulative elastic member 221 is urged to the photosensitive layer of the drum 1 with a force F, flexing forces A and B are produced at a bonding connection interface D between the insulative elastic member 221 and the charging electrode layer, simultaneously with the flexure of the supporting member 223. When the photosensitive layer 11 (drum 1) rotates in the direction indicated by C in part (b) of FIG. 8, the insulative elastic member 221 receives a force Fμ by friction from the photosensitive layer 11, and therefore, a larger force A' is applied to the bonding connection interface D. When the rotation stops, the applied force becomes A, again.

As a result of repetitions of the rotation and the stop of the photosensitive layer in this manner, the bonding between the insulative elastic member 221 and the charging electrode layer may fail. When the insulative elastic member 221 is partly peeled from the charging electrode layer 222 at the interface D, the gap between the charging electrode layer 11 and the photosensitive layer 222 which is the discharge portion is different depending on whether or not they are bonded or peeled at the portion. Then, the charged potential of the surface of the drum is not uniform, with the result of the image defect such as stripes attributable to the non-uniformity.

In addition, in an actual image forming apparatus, the contact states between the charging blade 22 and the drum 1 are different depending on the drums and blades. Particularly, when a virtual bite of the free end of the charging blade 22 into the surface of the drum 1 is large, the frictional force resulting from the rotation C of the photosensitive layer 11 is large, and therefore, the insulative elastic member 221 and the charging electrode layer 222 is easily peeled at the interface D. For these reasons, it has been desired that the variations in the charging blade state depending on the members are decreased to stabilize the gap g between the charge portion and the drum, thus further stabilizing the non-contact charging.

SUMMARY OF THE INVENTION

It is another object of the present invention to provide a blade-like charging member capable of reducing the influence of the charging blade state and capable of charging stably a drum, and an image forming apparatus using the charging member.

These and other objects, features and advantages of the present invention will become more apparent upon a consideration of the following description of the preferred embodiments of the present invention taken in conjunction with the accompanying drawings.

According to an aspect of the present invention, there is provided a blade-like charging member for charging a surface of an image bearing member by contacting thereto and by being supplied with a voltage, said charging member comprising a charging portion for effecting electric discharge to the surface of the image bearing member; a non-charging portion not effecting the electric discharge to the surface of the image bearing member; wherein non-charging portion is capable of contacting said image bearing member with maintaining an electrically dischargeable gap between said charging portion and said image bearing member, at least a part of said non-charging portion is made of a material having a higher resistance than that of said charging portion so as to prevent electric discharge between said non-charging portion and the surface of said image bearing member, and said non-charging portion is capable of sliding contact with said surface of said image bearing member over the entirety of an image forming region width of said surface of said image bearing member, said charge portion and said non-charging portion are bonded to each other by adhesive material at a connection interface, and said connection interface has such a configuration that a part of said charge portion projects into said non-charging portion, that a part of said non-charging portion projects into said charge portion, or that said charge portion and said non-charging portion project into the other.

DESCRIPTION OF THE PREFERRED EMBODIMENTS

Embodiment 1

Figure 2:
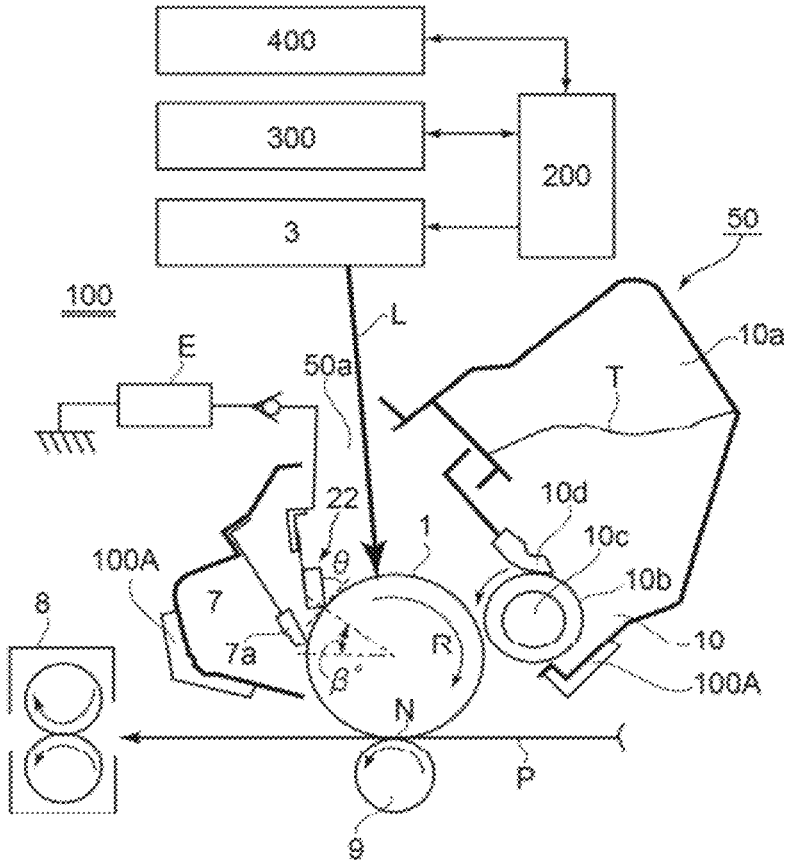
FIG. 2 is a schematic illustration of an example of an image forming apparatus.

(1) General Structure of an Example of an Image Forming Apparatus and an Image Forming Operation Thereof:

Referring first to FIG. 2, there is shown an example of an image forming apparatus 100 using a charging member 22 according to the present invention. The device 100 is an electrophotographic image forming apparatus of a process cartridge mounting and demounting type using an electrophotographic process. The device 100 forms an image on a recording material (recording material) P on the basis of an electrical image signal inputted to a control circuit portion (control means, CPU) 200 from a host apparatus 400 such as a personal computer, an image reader or a facsimile machine.

The recording material P is a sheet on which an image can be formed by an electrophotographic process, and is a sheet of paper, a resin material sheet, a label or the like.

The control circuit portion 200 exchange various electrical information with an operating portion 300 or the host apparatus 400, and controls overall image forming operation of the device 100 in accordance with predetermined control program and reference table stored in a storing portion.

In a main assembly of the apparatus of the device 100, there is provided a cartridge accommodating portion 100A. A process cartridge 50 is demountably mounted to the cartridge accommodating portion 100A through a predetermined operation manner. In this embodiment, the cartridge 50 is an integral type process cartridge. More particularly, an electrophotographic photosensitive drum as an image bearing member on which an electrostatic latent image developed with a developer T is formed, charging means 22, developing means 10 and cleaning means 7 are mounted to a common casing into a unit.

In this embodiment, the charging means 22 is a charging blade. The charging blade 22 will be described hereinafter. The developing means 10 is a non-contact-type developing device operable with one component magnetic toner as the developer T. In the following, the developer T will be called toner, too. The cleaning means 7 is a blade cleaning device using an elastic blade 7*a* as a cleaning member.

The developing device 10 includes a developing container 10*a* as a developer accommodating portion accommodating the toner T. It also includes a developing sleeve 10*b* as a developer carrying member for developing an electrostatic latent image formed on the drum 1 into a toner image, a non-rotatable magnet roller 10*c* provided in the sleeve 10*b*, a developing blade 10*d* for regulating an amount of the toner on the developing sleeve 10*b*, and so on.

Above the cartridge accommodating portion 100A, there is provided a laser scanner unit 3 as image exposure means. The unit 3 outputs a laser beam L modulated in accordance with the image information inputted to the control circuit portion 200 from the host apparatus 400. The laser beam L enters the cartridge 50 through an exposure window provided in a top side. By doing so, the surface of the drum 1 is scanningly exposed to a laser beam.

To the drum 1 in the cartridge 50, a transfer roller 9 is contacted to form a transfer nip N. The cartridge 50 accommodated in the cartridge accommodating portion 100A is urged to a positioning portion (unshown) in the main assembly side of the apparatus by an urging means (unshown) is correctly positioned. In addition, a drive outputting portion (unshown) of the main assembly side of the apparatus is connected to a drive inputting portion (unshown) of the cartridge 50. To various electrical contacts (unshown) of the cartridge 50, the corresponding electrical contacts (unshown) of the main assembly side of the apparatus are contacted.

The image forming operation is as follows. Drum 1 is rotated in the clockwise direction indicated by arrow R at a predetermined peripheral speed (process speed). The unit 3 is also driven. In synchronism with the drive, a predetermined charging bias voltage is applied from a charging bias voltage applying source E to the charging blade 22 at predetermined control timing so that the surface of the drum 1 is charged uniformly to the predetermined polarity and potential by the charging blade 22 by a non-contact type charging. The unit 3 scans and exposes the surface of the drum 1 by a laser beam L modulated in accordance with the image signal. By this, an electrostatic latent image is formed in accordance with the image signal on the surface of the drum 1.

The electrostatic latent image thus formed is developed into a toner image by the toner carried on the developing sleeve 10*b* of the developing device 10. The developing sleeve 10*b* is rotated in a counterclockwise direction indicated by an arrow at a predetermined speed. To the developing sleeve 10*b*, a predetermined developing bias voltage is applied at predetermined control timing from a developing bias applying voltage source portion (unshown).

On the other hand, one recording material P is separated and fed out of a sheet feeding mechanism portion (unshown) and is introduced into the transfer nip N at predetermined control timing and is nipped and fed through the nip N. During the recording material P moving the nip N, a predetermined transfer bias is applied to the transfer roller 9 from a transfer bias application voltage source portion (unshown) By this, the toner image is transferred from the drum 1 onto the surface of the recording material P sequentially.

The recording material P having passed through the nip N is separated from the surface of the drum 1 and is introduced into the fixing device 8. In this embodiment, the fixing device 8 is a heat roller fixing device, and the recording material P is nipped and fed by a fixing nip and is subjected to heat and pressure. By this, the unfixed toner image on the recording material P is heat-pressure fixed into a fixed image. The recording material P discharged from the fixing device 8 is discharged from the device 100 as a print. The surface of the drum 1 after the recording material is separated, is cleaned by a cleaning blade 7*a* so that deposited residual matter such as untransferred toner is removed therefrom, thus it is prepared for the next image formation.

Figure 3:
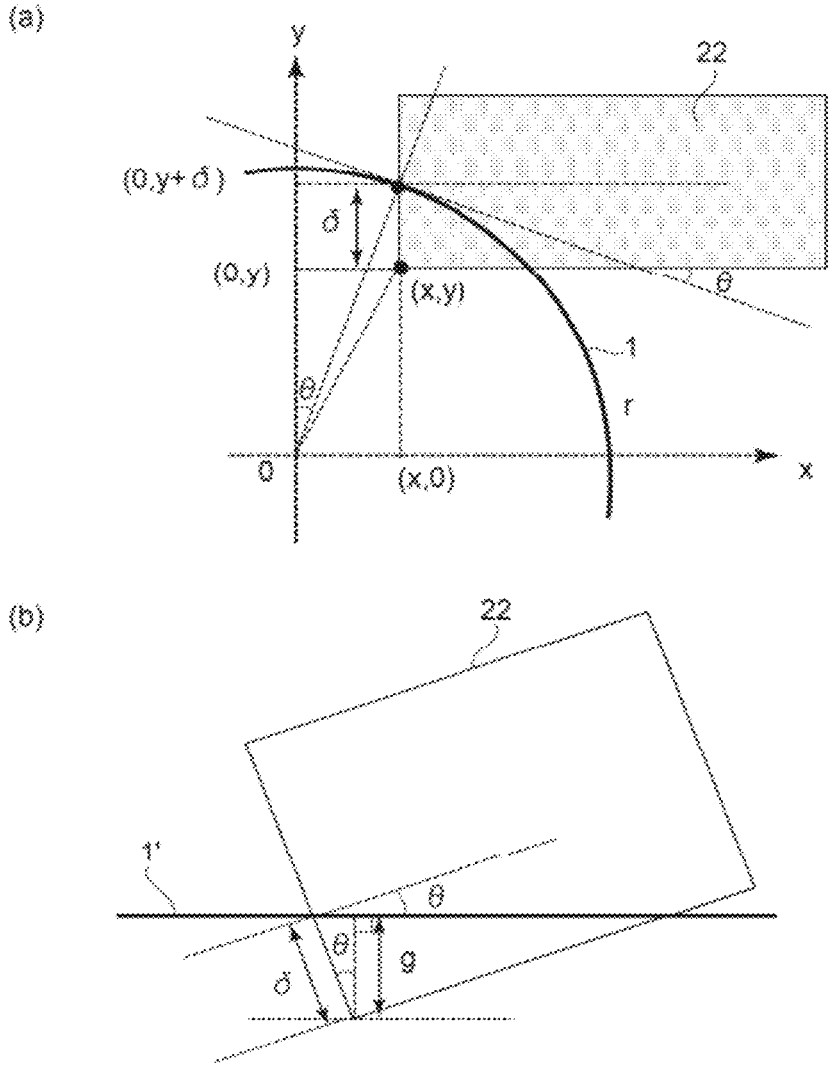
FIGS. 3(*a*) and 3(*b*) illustrate a virtual bite δ of a charging blade.

(2) Charging Blade 22:

The charging blade 22 is contacted to the drum counterdirectionally with respect to the rotation of the drum 1 at a position of β degree from a horizontal line passing through the center of the drum 1 (the angle β is formed between the horizontal line and a line connecting the drum center and the contact position between the drum 1 and the blade 22) As shown in FIG. 3, the blade 22 enters the drum 1 if the drum 1 is phantom, and the entering distance δ is called virtual bite; actually, the charging blade 22 deforms by this distance by the press-contact between the charging blade 22 and the drum 1 so that the behavior of the charging blade is stabilized.

The virtual bite δ is a phantom amount by which the free end of the charging blade 22 enters the drum 1 without deformation, and the set angle θ is an angle formed between a tangent line and the charging blade at a point where the free end of the charging blade and the drum 1 intersect. Here, an example of determining an actual virtual bite δ and a setting angle θ. Referring to part (a) of FIG. 3, the charging blade 22 and the drum 1 are set in the state of image forming operation, and the drum 1 is removed, and then the virtual bite δ and the θ are measured.

In part (a) of FIG. 3, the shown drum 1 is a phantom drum 1 during image formation. X axis passes through the center of the phantom drum and is parallel with such a surface of the charging blade 22 as is opposed to the drum 1. Y axis is perpendicular to the X shaft and passes through the center of the phantom drum 1. As shown in Figure, coordinate (X, Y) of the free end of the charging blade 22 is determined. From the coordinate and the radius r of the phantom drum 1 the virtual bite δ and the setting angle θ can be obtained by equation (1) and equation (2).

$$\delta=\sqrt{(r^2-x^2)}-y \quad (1)$$

$$\theta=\sin^{-1}(x/r) \quad (2)$$

Referring to part (b) of FIG. 3, the description will be made as to the case in which the object contacted by the charging blade is a flat surface 1' such as a photosensitive belt. This case is different from the case of part (a) of FIG. 3, that is, the set angle θ does not change even if the contact position of the charging blade changes. Therefore, the set angle θ which is an angle relative to a phantom belt can be determined by measuring a mounting angle of the blade relative to the phantom belt flat surface F. The virtual bite δ is determined by the following equation (3) from the set angle θ and a distance g from the phantom belt to the blade edge:

$$\delta = g/\cos\theta \quad (3)$$

From equations (1)-(3), the set angle θ of the charging blade 22 and the virtual bite δ can be determined.

Figure 1:
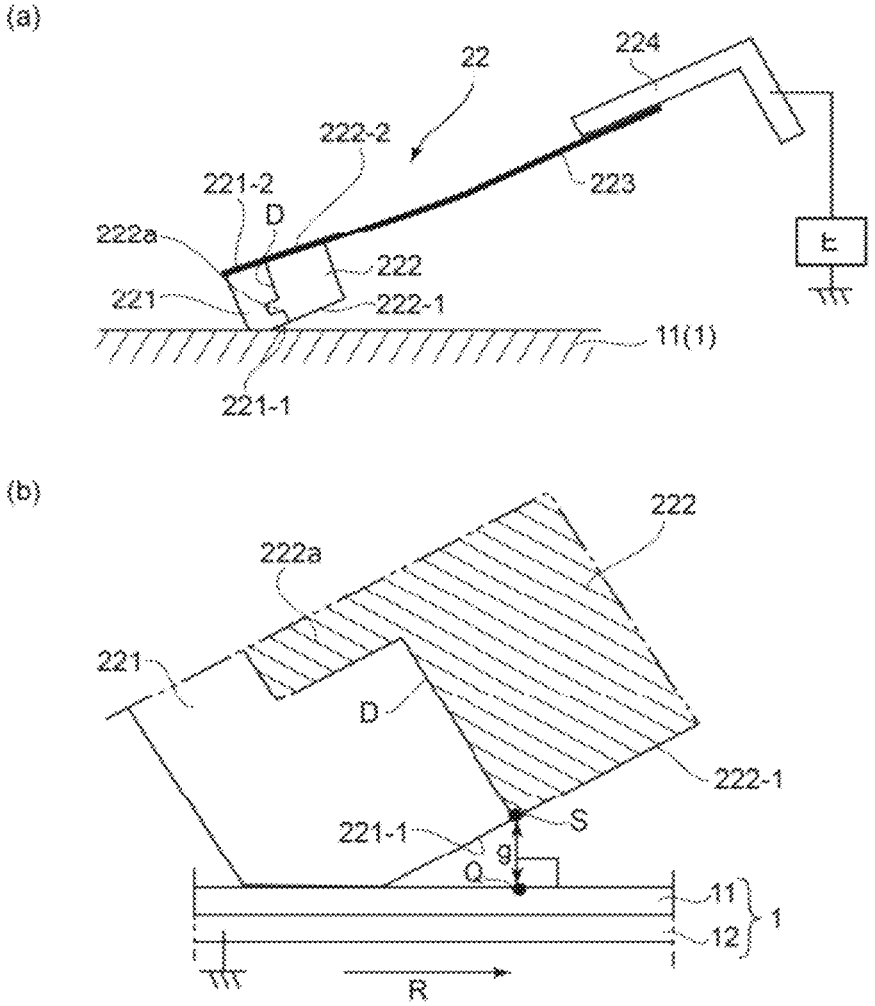
In FIG. 1, part (a) is an illustration of a charging blade according to Embodiment 1 of the present invention, and part (b) is a partly enlarged view.

Referring to FIG. 1, part (a) is an enlarged schematic cross-sectional view of the charging blade 22 of the device 100 of FIG. 2, and part (b) is a partly enlarged view of the (a). The charging blade 22 of this embodiment contacts the drum 1 and moves relative thereto, and a voltage is applied thereto by which the surface of the drum 1 is charged. It comprises a charging portion 222 for effecting discharge to the surface of drum 1, and a non-charging portion 221 which does not effect the discharge to the surface of drum 1. The charge portion 222 and the non-charging portion 221 are bonded to each other by adhesive material. Designated by D is a bonding connection interface.

Figure 7:
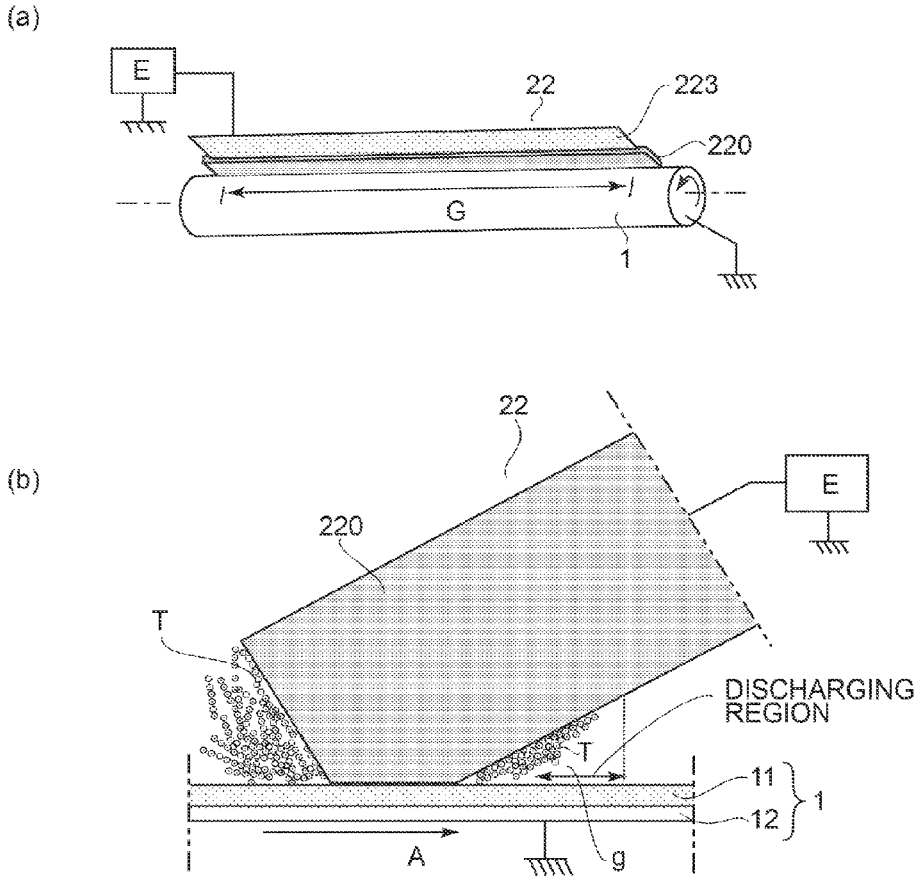
FIG.7 PRIOR ART
In FIG. 7, part (a) is a schematic perspective view the charging blade, and (b) illustrates a problem.
Figure 8:
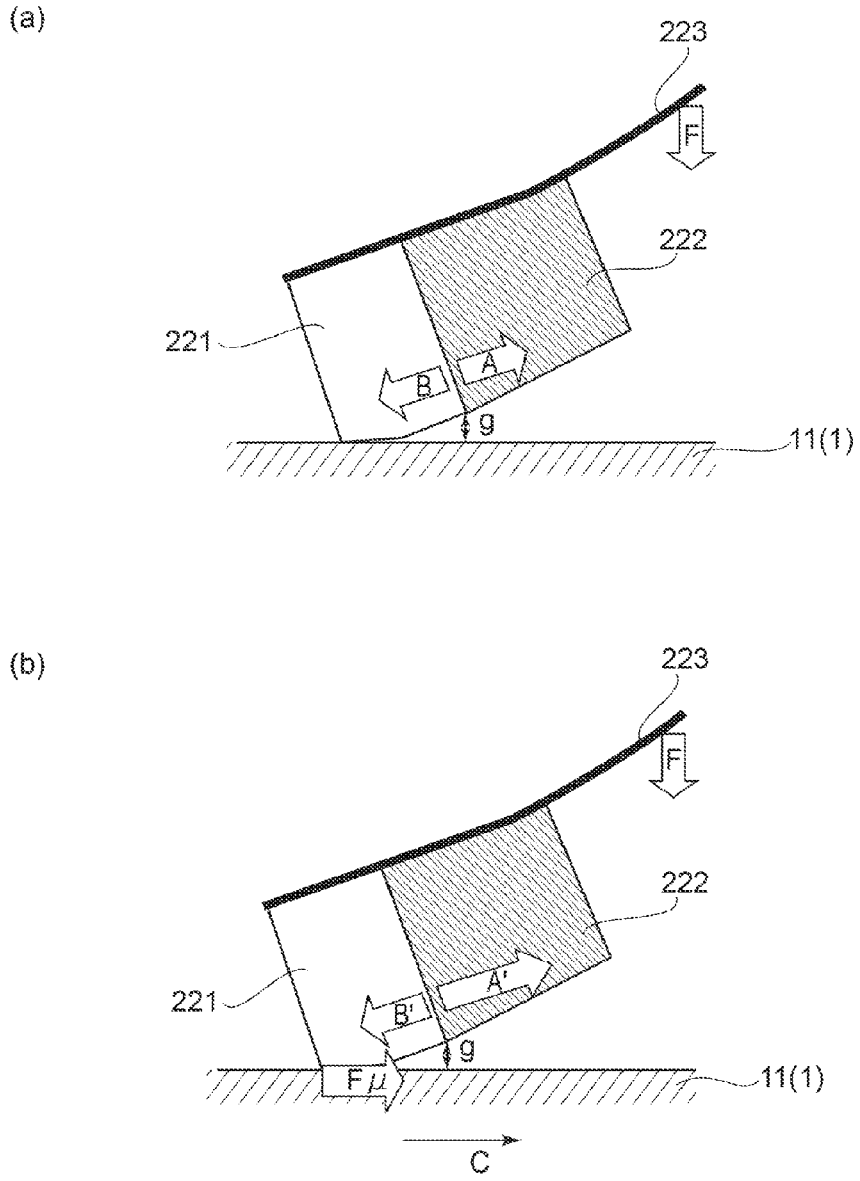
FIG.8 PRIOR ART
FIGS. 8(*a*) and 8(*b*) illustrate peeling between a non-charging portion and a charge portion of the charging blade at the bonding connection interface therebetween.

The non-charging portion 221 contacts the drum 1 to provide a gap between the charging portion 222 and the drum 1, across which the electric discharge occurs. At least a part of the non-charging portion 221 is made of a high resistance material having a resistance higher than that of the charging portion 222 to prevent discharge between the non-charging portion 221 and the surface of the drum 1. The non-charging portion 221 contacts the surface of drum 1 which is the image bearing member in the range of the width of the image forming region G (predetermined charging region width in part (a) of FIG. 7 and slides thereon. That is, the entire longitudinal area of the free end portion of the charging blade 22 contacts the drum 1.

The charge portion 222 and the non-charging portion 221 are supported by a metal elastic supporting member (metal plate spring member) 223. In more detail, the non-charging portion 221 and the charge portion 222 are supported by the supporting member 223 at the second surfaces 221-2, 222-2 which are opposite the first surfaces 221-1, 222-1 contacted or closer to the drum 1.

The supporting member 223 is supported by the holder 224. The holder 224 is made of an electroconductive material in this embodiment, and the holder 224 and the charge portion 222 are electrically conducted by the elastic supporting member 223. The charge portion 222 and the non-charging portion 221 are elongate enough in the direction of the generatrix of the drum 1 to cover the entire area of the image forming region width G (part (a) of FIG. 7, predetermined charging region width).

Charging blade 22 is disposed parallel to the generatrix direction of the drum 1. A edge portion of the non-charging portion 221 is contacted to the drum 1, the holder 224 is fixed to the casing of the cartridge 50, and the edge portion is contacted to the drum 1 at a predetermined urging force by a elastic reaction force of the elastic supporting member 223. In this contact state, the charging portion 222 is out of contact to the drum 1. And, the discharging position 220 of the charging portion 222 is out of contact with a dischargeable gap g from the drum 1.

The predetermined charging bias voltage is applied to the electroconductive holder 224 from charging bias voltage applying source E, and the bias voltage is applied to the charging portion 222 through the holder 224 and the elastic supporting member 223. By this, the discharge occurs to the surface of drum 1 across the small gap g between the charging portion 222 and the drum 1 to charge uniformly the surface of the rotating drum 1 to the predetermined polarity and potential.

In this embodiment, the discharge can start in the direction of a perpendicular line QS from a point S (part (b) of FIG. 1) on the bonding connection interface D between the non-charging portion 221 and the charge portion 222 of the charging blade 22. The point S on the charge portion 222 is at the closest position relative to the surface of drum 1, so that the stabilized discharge is accomplished irrespective of the blade virtual bite δ.

In this embodiment, the length of the line segment QS (small gap) g is not less than 7.5 μm and not more than 150 μm. If the small gap g is less than 7.5 μm, the discharge does not occur as will be understood from the Paschen law. If, on the other hand, the small gap g is not less than 150 μm, the discharge occur, but is non-uniform with the result of defective image having spots. Therefore, for the stabilized discharge, the gap g is desirably not more than 100 μm.

Figure 4:
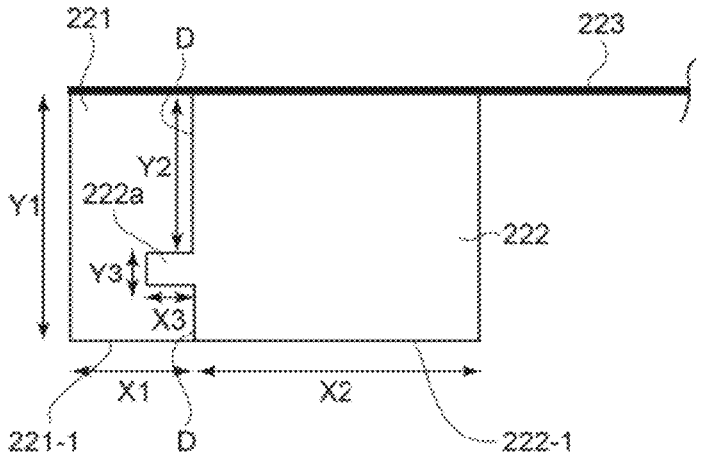
FIG. 4 is an illustration of a major part of the charging blade according to Embodiment 1.

In the charging member 22 of this embodiment, the charge portion 222 has a configuration (projected portion 222*a*) projected toward the non-charging portion 221. As shown in FIG. 4, the projected portion 222*a* projects from the position 1.4 mm (Y2) away from the supporting member 223 toward the free end of the non-charging portion 221, in which a dimension (projection amount) is 0.5 mm, and a width Y3 is 0.2 mm. A width X2 of the charge portion 222 without taking the projected portion 222*a* into account is 5 mm, and the thickness Y1 of the charge portion 222 is 2 mm which is the same as that of the non-charging portion 221.

That is, in the charging member 22 of this embodiment, the non-charging portion 221 and the charge portion 222 are supported by the supporting member 223 at the second surfaces 221-2, 222-2 which is opposite the first surfaces 221-1, 222-1 adjacent to the drum 1. A part of the configuration 222*a* (221*a*) projected toward the charge portion 221 (or toward charge portion 222) is in the side closer to the first surface beyond the middle point between the first surface and the second surface along Y1.

<Charge Portion 222>

The charging portion 222 comprises rubber such as epichlorohydrin rubber, EPDM and electroconductive powder such as carbon black, metal oxide (zinc oxide, oxide titanium) added thereto to provide a resistance value of 1×10^3-1×10^9 Ωcm.

If the resistance of the charging portion 222 is smaller than 1×10^3 Ωcm, the current leakage may occur when the drum 1 has a defect such as a pin hole, with the result of image defect white strips or black stripes. If, on the contrary, it is not less than 1×10^9 Ωcm, the attenuation of applied voltage is so large that the chargeable is poor. Therefore, the resistance value of the charging portion 222 is desirably 1×10^3 Ωcm-1×10^9 Ωcm.

<Non-Charging Portion 221>

The non-charging portion 221 directly contacts the drum 1 at the free end portion of the charging blade 22 and covers the projected portion 222*a* of the charge portion 222 as shown in FIG. 4. In this embodiment, the non-charging portion 221 of the charging blade 22 is made of urethane rubber having a hardness of 72 degrees, and the width X1 of the urethane rubber is 1 mm, and a thickness Y1 of the urethane rubber is 2 mm. A volume resistivity of the urethane rubber is not less than 10^11 Ωcm. In place of the urethane rubber, insulative rubber or the like silicone rubber may be used, if the resistance value of the non-charging portion 221 is enough to prevent the discharge relative to the drum 1.

<Supporting Member 223>

The supporting member 223 is made of phosphor bronze (thickness t=0.1 mm) in this embodiment. The supporting member 223 is fixed to the holder 224 which is mounted to the casing of the cartridge 50. The supporting member 223 may be made of SUS thin plate or the like. The holder 224 may be mounted to the main assembly of the image forming apparatus, or the supporting member 223 may be fixed directly to the casing of the cartridge 50 or to the main assembly of the image forming apparatus.

<Connection Between the Non-Charging Portion 221 and Charge Portion 222>

The charge portion 222 has a configuration (projected portion) 222*a* projecting into or toward the non-charging portion 221, and covers the projected portion 222*a* also in the non-charging portion 221 side. A primer (adhesive material) is applied to the connection interface D between the non-charging portion 221 and the charge portion 222 over the entire longitudinal range, and thereafter, the non-charging portion 221 is fitted around the projected portion 222*a* of the charge portion 222, thus connecting and bonding them.

(3) Verification Experiment:

Image formation tests were carried out with the charging blade 22 of FIG. 1 mounted with the virtual bite δ=0.5, 0.7, 0.9, 1.1, 1.3, 1.5 mm. For comparison, the tests were carried out with a charging blade having a flat bonding connection interface D between the charge portion 222 and the non-charging portion 221 shown in part (a) of FIG. 5 (comparison example 1). The charging blade of comparison example 1 do not have the projected portion 222*a* as contrasted to this embodiment, but the other structure conditions are the same as the charging blade of this embodiment.

<Image Formation Condition>

Process speed: 100 mm/sec

Photosensitive drum diameter: 24 mm

Cleaning blade 7*a*: urethane rubber, counterdirectional contact

Applied charging bias voltage: DC-1050V

Potential setting: dark portion VD=−500V, light portion VL=−150V

Half-tone portion VH=−350V

The results are shown in Table 1. In the case of the tests of the charging blade 22 of this embodiment with the virtual bite δ of 1.3 up to 10000 sheets, no peeling occurs at the bonding connection interface D between the charge portion 222 and the non-charging portion 221, and the charging property was uniform over the entire area of the image. With the virtual bite δ of 1.5, very insignificant peeling which did not cause any practical problem partly occurred.

In the case of the comparison example 1, the peeling occurred at the bonding connection interface D between the charge portion 222 and the non-charging portion 221 when the virtual bite δ was 1.3 or more, with the result of non-uniform image.

TABLE 1

| | Image Evaluation | | | | | |
|---|---|---|---|---|---|---|
| | Virtual bite δ (mm) | | | | | |
| | 0.3 | 0.7 | 0.9 | 1.1 | 1.3 | 1.5 |
| Embodiment | G | G | G | G | G | F |
| Comparison Example | G | G | G | F | NG | NG |

G: Good
F: Fair (practically no problem)
NG: No good (non-uniform charging (stripes, no charging)

The causes of the facts are considered as follows. In comparison example 1, in the contact of the non-charging portion 221 to the drum 1, the force deforming the supporting member 223 tends to separate the non-charging portion 221 and the charge portion 222 from each other at the bonding connection interface D. By the rotation of the drum 1, the force resulting from the friction between the non-charging portion 221 and the drum 1 enhances the separating force. When the rotation of the drum 1 stops, the force produced by the friction disappears. By the repetition of the separating force produced by the friction, the separation at the interface D is enhanced.

On the other hand, in this embodiment, the projected portion of the charge portion 222 which project into the non-charging portion 221 is bonded and is resistive to the separation force at the interface. Therefore, even if the force is intermittently repeated, the separation or peeling at the interface D does not easily occur with a increased virtual bite δ.

Additional verification tests were carried out. The assessment is the same as the foregoing verification tests.

Figure 5:
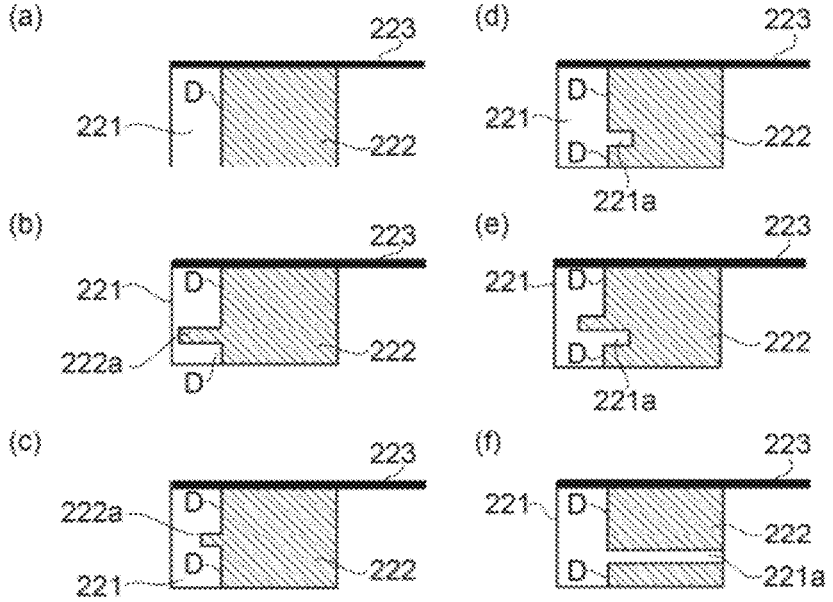
FIGS. 5(*a*)-5(*f*) illustrate modified specific examples of Embodiment 1 and a comparison example.
Figure 6:
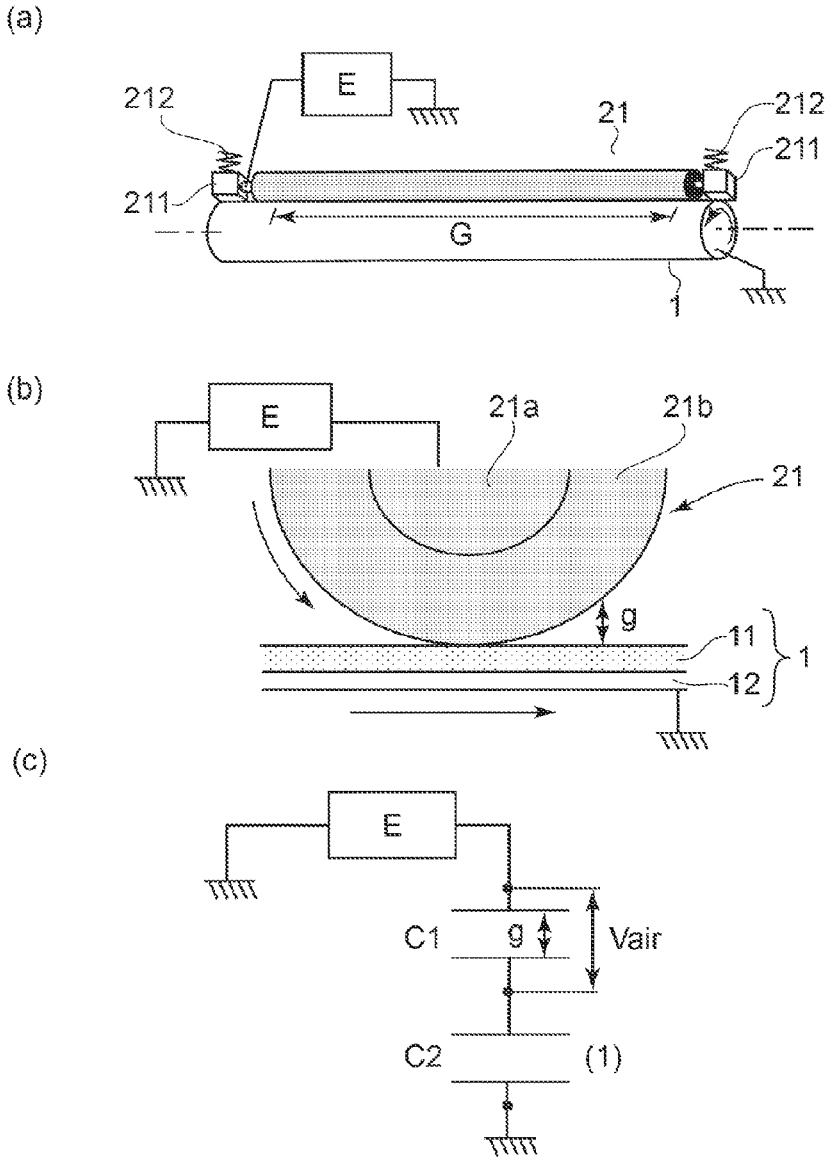
FIG.6 PRIOR ART
In FIG. 6, part (a) when part (b) are schematic perspective views of a charging roller, and part (c) is an electrical equivalent circuit diagram of a charging roller, a drum and an air layer of a fine gap therebetween.

Modified specific example 1: projection amount of the projected portion 222*a* toward the non-charging portion 221 from the charge portion 222 is increased (part (b) of FIG. 5).

Modified specific example 2: the position of the projected portion 222*a* toward the non-charging portion 221 from the charge portion 222 is changed (part (c) of FIG. 5).

Modified specific example 3: the projected portion 221*a* toward the charge portion 222 is provided on the non-charging portion 221 (part (d) of FIG. 5).

Modified specific example 4: the non-charging portion 221 and the charge portion 222 are provided with projected portions 221*a*, 222*a*, respectively (part (e) of FIG. 5).

Comparison example 2: the projection amount of the projected portion 221*a* toward the charge portion 222 from the non-charging portion 221 is increased (part (f) of FIG. 5).

The results are shown in Table 2. With respect to specific example 1, no peeling or separation occurred at the interface between the non-charging portion 221 and the charge portion 222 irrespective of the virtual bite δ, and stabilized images were produced throughout the image formation tests. With respect to specific example 2, when the virtual bite δ is 1.3, very insignificant peeling which did not cause any practical problem partly occurred, and when the virtual bite δ is 1.5, the peeling occurred at the bonding connection interface D between the charge portion 222 and the non-charging portion 221.

With respect to specific example 3, similarly to the embodiment, very slight separation occurred partly, but was not a practical problem when the virtual bite δ was 1.5. As for specific example 4, similarly to the specific example 1, no peeling or separation occurred at the interface between the non-charging portion 221 and the charge portion 222 irrespective of the virtual bite δ, and stabilized images were produced throughout the image formation tests. With respect to comparison example 2, improper charging images were produced irrespective of the virtual bite δ.

TABLE 2

| | Image Evaluation | | | | | |
|---|---|---|---|---|---|---|
| | Virtual bite δ (mm) | | | | | |
| | 0.3 | 0.7 | 0.9 | 1.1 | 1.3 | 1.5 |
| Specific Ex. 1 | G | G | G | G | G | G |
| Specific Ex. 2 | G | G | G | F | F | NG |
| Specific Ex. 3 | G | G | G | G | G | F |

TABLE 2-continued

| | Image Evaluation | | | | | |
|---|---|---|---|---|---|---|
| | Virtual bite δ (mm) | | | | | |
| | 0.3 | 0.7 | 0.9 | 1.1 | 1.3 | 1.5 |
| Specific Ex. 4 | G | G | G | G | G | G |
| Comparison Ex. 2 | NG | NG | NG | NG | NG | NG |

G: Good
F: Fair (practically no problem)
NG: No good (non-uniform charging (stripes, no charging)

The causes of the facts are considered as follows.

In specific example 1 ((b) of FIG. 5), the projection amount X3 is large, that is, X3=0.9 mm. Because of the integral covering of the projected portion 222*a* of the charge portion 222 by the non-charging portion 221 and the bonding area resistive to the flexure force, the resistance against the peeling at the interface D is high.

In specific example 2 (part (c) of FIG. 5), the position of the projected portion 222*a* is shifted upward away from the surface of drum 1 to the middle point of the thickness of the charge portion 222, so that the projection starts at Y2=0.9 mm, and the width Y3 of the projection is 0.2 mm. The force is applied at the drum surface, the separating force applied at the bonding portion increases with the upward shifting of the position of the bonding of the projected portion 222*a*. Therefore, the resistance against the separation reduces.

With respect to specific example 3 (part (d) of FIG. 5), in which the projected portion 221*a* extends from the non-charging portion 221 toward the charge portion 222, the same advantageous effects are provided. The bonding portion is provided at the non-charging portion 221 and is resistive against the peeling force. No peeling occurred even when the virtual bite δ is large.

The projected portion 222*a* is linear symmetrical with the shape of the basic example of this embodiment (FIG. 4), and the dimensions are the same, although the projected portion 222*a* extends from the non-charging portion 221 side.

In specific example 4 (part (e) of FIG. 5), the projected portion 222*a* extends from the charge portion 222 toward the non-charging portion 221. In addition, the projected portion 221*a* extended from the non-charging portion 221 toward the charge portion 222, no charging non-uniformity or interface peeling between the charge portion 222 and the non-charging portion 221 occurred irrespective of the virtual bite δ.

This is because there are provided bonded positions resistive against opposite forces in the interface portion between the charge portion 222 and the non-charging portion 221, and therefore, the bonding is secured. For this reason, the bonding is relatively more resistive against the bonding.

The structure is more specifically such that the projection 222*a* from the charge portion 222 toward the non-charging portion 221 projects from the position of Y2=1 mm, the projection amount X3=0.5 mm, and the projection width Y3=0.2 mm. Thereafter, the projected portion 221*a* of the same projection amount and the same width are extended from the non-charging portion 221 toward the charge portion 222.

In comparison example 2 (part (f) of FIG. 5), in which the projected portion 221*a* extending from the non-charging portion 221 into the charge portion 222 by the same amount (projection amount X3) the width (5 mm) of the charge portion 222, the electroconductive path of the charge portion 222 is disturbed by the non-charging portion 221, and therefore, the charging of the drum is not accomplished. Therefore, the improper charging image resulted irrespective of the virtual bite δ.

It is desirable to provide the bonded position or positions so as not to impede the electroconductive path of the charge portion 222.

In summary, a part 222*a* of the charge portion 222 projects toward the non-charging portion 221 in the connection interface D between the charge portion 222 and the non-charging portion 221, and they are bonded at the connection interface D by adhesive material. Or, a part 221*a* of the non-charging portion 221 projects toward the charge portion 222, and they are bonded at the connection interfaces D and D by adhesive material. Or, the charge portion 222 and the non-charging portion 221 partly project toward each other at 222*a* and 221*a*, and they are bonded to each other at the connection interface D. And, the bonded portions are provided against the flexure force at the interfaces D without blocking or impeding the electroconductive path of the charge portion 222.

[Others]

The blade-like charging member 22 of the present invention is not limited to the structure in which the entirety of the non-charging portion 221 not effecting the discharge relative to the surface of the image bearing member 1 is made of insulative material having a resistance value not discharging relative to the image bearing member 1. The non-charging portion 221 may be made of electroconductive or semiconductive material if it is electrically disconnected with the electroconductive path. It may be made of a combined member comprising an insulative material and an electroconductive or semiconductive material. Thus, it will suffice of at least a part of the non-charging portion 221 is made of a material having a resistance higher than that of the charge portion 222.

1) the image bearing member on which the electrostatic latent image is formed is not limited to the electrophotographic photosensitive member for an electrophotographic type apparatus of the embodiments. It may be a dielectric member for electrostatic recording for an electrostatic recording type apparatus. The image bearing member is not limited to the drum type. It may be an endless rotatable belt, a traveling non-endless belt or the like. The image bearing member may be a sheet-like member (electro-facsimile machine paper, electrostatic recording paper) fed by a feeding means.

2) the relative movement between the image bearing member and the charging member is not limited to the case in which the image bearing member moves relative to the fixed charging member as in the foregoing embodiments, but the charging member may move relative to the fixed image bearing member, or both of the charging member and the image bearing member move with relative movement therebetween.

3) the contact of the charging member relative to the image bearing member is not limited to the counterdirectional contact as in the foregoing embodiments, but the codirectional contact may be employed. In addition, the edge contact is not inevitable, but convex contact can be employed.

4) in the present invention, the charging of the surface of the image bearing member by the charging member is not limited to applying the electric charge thereto, but includes the case of electrically discharging the image bearing member, that is, removing the electric charge from the image bearing member. In addition, the blade-like charging member of the present invention is usable as a cleaning charging blade.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 278183/2010 filed Dec. 14, 2010 which is hereby incorporated by reference.

What is claimed is:

1. A blade-like charging member for charging a surface of an image bearing member by contacting thereto and by being supplied with a voltage, said blade-like charging member comprising:

a charging portion for effecting electric discharge to the surface of the image bearing member; and a non-charging portion not effecting the electric discharge to the surface of the image bearing member, wherein said non-charging portion is capable of contacting the image bearing member while maintaining an electrically dischargeable gap between said charging portion and the image bearing member, wherein at least a part of said non-charging portion is made of a material having a higher resistance than that of said charging portion so as to prevent electric discharge between said non-charging portion and the surface of the image bearing member, wherein said non-charging portion is capable of sliding contact with the surface of the image bearing member over the entirety of an image forming region width of the surface of the image bearing member, wherein said charge charging portion and said non-charging portion are bonded to each other by adhesive material at a connection interface, and wherein said non-charging portion is provided with a projection and said charging portion is provided with a recess engaged with said projection.

2. The blade-like charging member according to claim 1, wherein said non-charging portion and said charging portion have first surfaces adapted to be facing the image bearing member and second surfaces opposite said first surfaces, and said non-charging portion and said charging portion are supported by a supporting member at said second surfaces, and wherein a part of said projection is in a first surface side beyond a middle point between said first surfaces and said second surfaces.

3. An image forming apparatus comprising:

said blade-like charging member according to claim 1; and a voltage source for applying a voltage to said blade-like charging member.

4. The blade-like charging member according to claim 1, wherein said charging portion is provided with a projection and said non-charging portion is provided with a recess, and wherein said projection of said charging portion is engaged with the recess of said non-charging portion.

5. The blade-like charging member according to claim 1, wherein a plurality of projections are provided.

* * * * *